US007922105B2

(12) United States Patent
Zagorsky

(10) Patent No.: US 7,922,105 B2
(45) Date of Patent: Apr. 12, 2011

(54) ATOMIZER ADAPTER FOR PAINT SPRAYER

(75) Inventor: Eran Zagorsky, Northridge, CA (US)

(73) Assignee: Benron Equipment and Supply, Inc., Van Nuys, CA (US)

( * ) Notice: Subject to any disclaimer, the term of this patent is extended or adjusted under 35 U.S.C. 154(b) by 434 days.

(21) Appl. No.: 12/148,436

(22) Filed: Apr. 17, 2008

(65) Prior Publication Data

US 2008/0257987 A1 Oct. 23, 2008

Related U.S. Application Data

(60) Provisional application No. 60/925,349, filed on Apr. 19, 2007.

(51) Int. Cl.
*B05B 7/30* (2006.01)

(52) U.S. Cl. ..... 239/340; 239/373; 239/418; 239/424; 239/499; 239/525; 239/526

(58) Field of Classification Search ..... 239/340, 239/373, 398, 418, 419, 423, 424, 499, 525, 239/526

See application file for complete search history.

(56) References Cited

U.S. PATENT DOCUMENTS

| | | | | | |
|---|---|---|---|---|---|
| 1,566,325 | A | * | 12/1925 | Hansen | 239/340 |
| 2,886,252 | A | * | 5/1959 | Ehrensperger | 239/526 |
| 3,236,459 | A | * | 2/1966 | McRitchie | 239/424 |
| 6,062,494 | A | * | 5/2000 | Mills | 239/373 |

* cited by examiner

*Primary Examiner* — Steven J Ganey
(74) *Attorney, Agent, or Firm* — Elliott N. Kramsky

(57) ABSTRACT

An atomizer adapter for application of heavy viscous material from an airless paint sprayer. The adapter includes a housing that is coupled to the output of the sprayer through one housing port by an elongated tube that delivers viscous material and to the output of an air compressor through another housing port that delivers compressed air through a conduit. A nozzle within the housing directs pressurized air into an internal chamber where it is directed at and atomizes the flow of viscous material prior to output through an aperture in a tip fixed to the housing.

1 Claim, 2 Drawing Sheets

ATOMIZER ADAPTER FOR PAINT SPRAYER

REFERENCE TO RELATED APPLICATION

The present application claims the priority of provisional patent application Ser. No. 60/925,349 of inventor Eran Zagorsky for "Atomizer Adapter For Drywall-Capable Paint Sprayer" filed Apr. 19, 2007 in the United States Patent and Trademark Office.

BACKGROUND

1. Field of the Invention

The present invention relates to spraying apparatus suitable for both paint and heavy viscous materials, such as drywall joint compound, elastomeric paint and other heavy pastes commonly used in construction. More particularly, this invention pertains to an adapter for enhancing the atomizing capability of an otherwise-conventional gun for such spraying apparatus.

2. Description of the Prior Art

Methods for application of atomized particles of coating material (e.g. drywall joint compound) to a surface to produce a texturized effect have included, for example, aerosols and the so-called hopper gun.

Each of the above methods has significant drawbacks. The costs associated with aerosol application of coatings essentially limits such methods to patching and other jobs of relatively-limited scope. A hopper gun is a bulky device that is held or carried by a workman while disbursing atomized material. The material is gravity-fed from a hopper that comprises a part of the gun. The hopper portion of the gun lies above an outlet and an atomization chamber that is fed air from a compressor. The weight of the material carried in the hopper gun can be excessive and greatly taxing to the workman. A hopper gun may carry up to two gallons of material while one-half gallon of material may be required for texturized coating of a ceiling (while, of course, holding the hopper gun overhead). As a result, frequent work stoppages (involving not only refilling of the hopper but also cleaning of the gun) are required, prolonging and complicating jobs of any significant scope.

SUMMARY OF THE INVENTION

The present invention addresses the preceding and other shortcomings of the prior art by providing an atomizer adapter for an airless sprayer.

The adapter includes a housing having a first port for receiving viscous material and a second port for receiving compressed air. A hollow atomizing chamber is internal to the housing for combining compressed air with the viscous material to atomize the material therein. A tip is provided having an aperture for disbursing the atomized viscous material from the housing.

The foregoing and other features of the invention will become further apparent from the detailed description below. Such description is accompanied by a set of drawing figures. Numerals of the drawing figures, corresponding to those of the written description, point to the features of the invention with like numerals referring to like features throughout.

DETAILED DESCRIPTION OF THE PREFERRED EMBODIMENT

Figure 1:
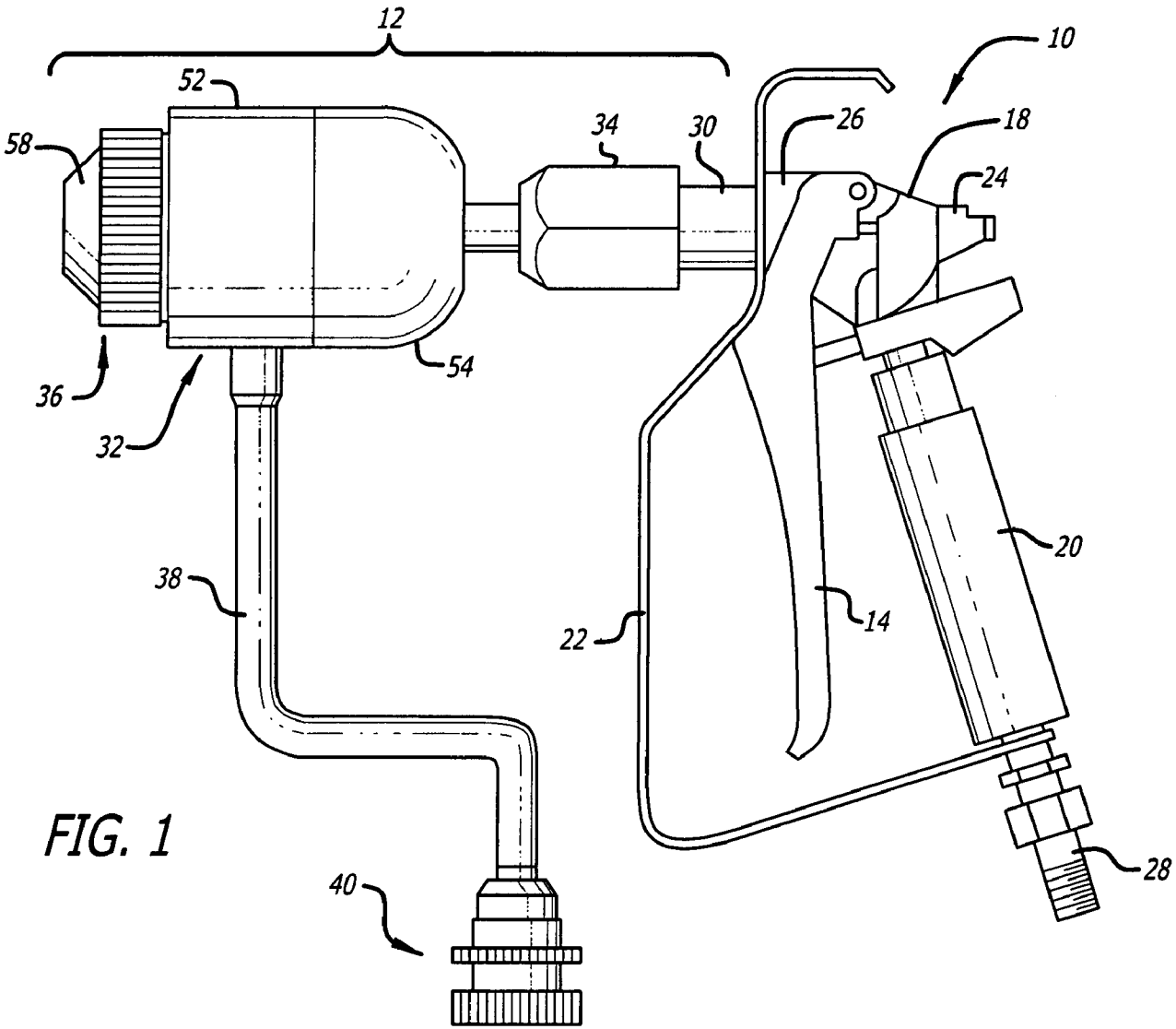
FIG. 1 is a side elevation view of an airless paint sprayer with atomizer adapter in accordance with the invention.

FIG. 1 is a side elevation view of an airless paint sprayer 10 with atomizer adapter unit 12 in accordance with the invention.

The sprayer 10 is of a conventional type that is commonly utilized for applying paint to a surface. Paint is provided to the sprayer 10 by a pump (typically a diaphragm, piston or gear pump). A suction tube has one end coupled to the pump inlet with the free end insertable into a paint container. A high pressure hose connects the pump outlet to the sprayer 10. A check valve is installed at the pump outlet. The sprayer 10 includes a trigger 14 that, when depressed, opens a valve that allows pressurized paint in the hose to flow. The paint is atomized upon exiting the sprayer through a specialized paint sprayer tip that includes a small aperture to allow a painter holding the sprayer 10 to apply paint evenly to a surface.

The sprayer 10 includes a hollow, pistol-shaped body 18 that includes a handle 20 (which typically doubles as a housing for a removable screen filter (not shown)), the squeezable trigger 14, a trigger guard 22, an internal valve assembly 24 that is controlled by the trigger 14 to control the flow of paint to an output barrel 26.

A threaded coupling 28 at the bottom of the handle 20 is provided for attaching a high pressure hose from a pump unit. The drywall atomizer adapter unit 12 is attached to the end 30 of the output barrel 26.

The adapter assembly unit 12 includes an adapter housing 32. A connector 34 attaches one end of the adapter housing 32 to the end 30 of the output barrel 26 while a spray guard 36 surrounds and provides threaded attachment of a spray tip 58 to the opposed end of the housing 32. An L-shaped conduit 38 is threadedly attached to the bottom of the housing 32 for selectively inputting airflow from a compressor (not shown). The opposed end of the conduit 38 is fitted to an in-line, manually adjustable air flow valve 40 for adjusting the flow of compressed air into the housing 12.

Figure 2:
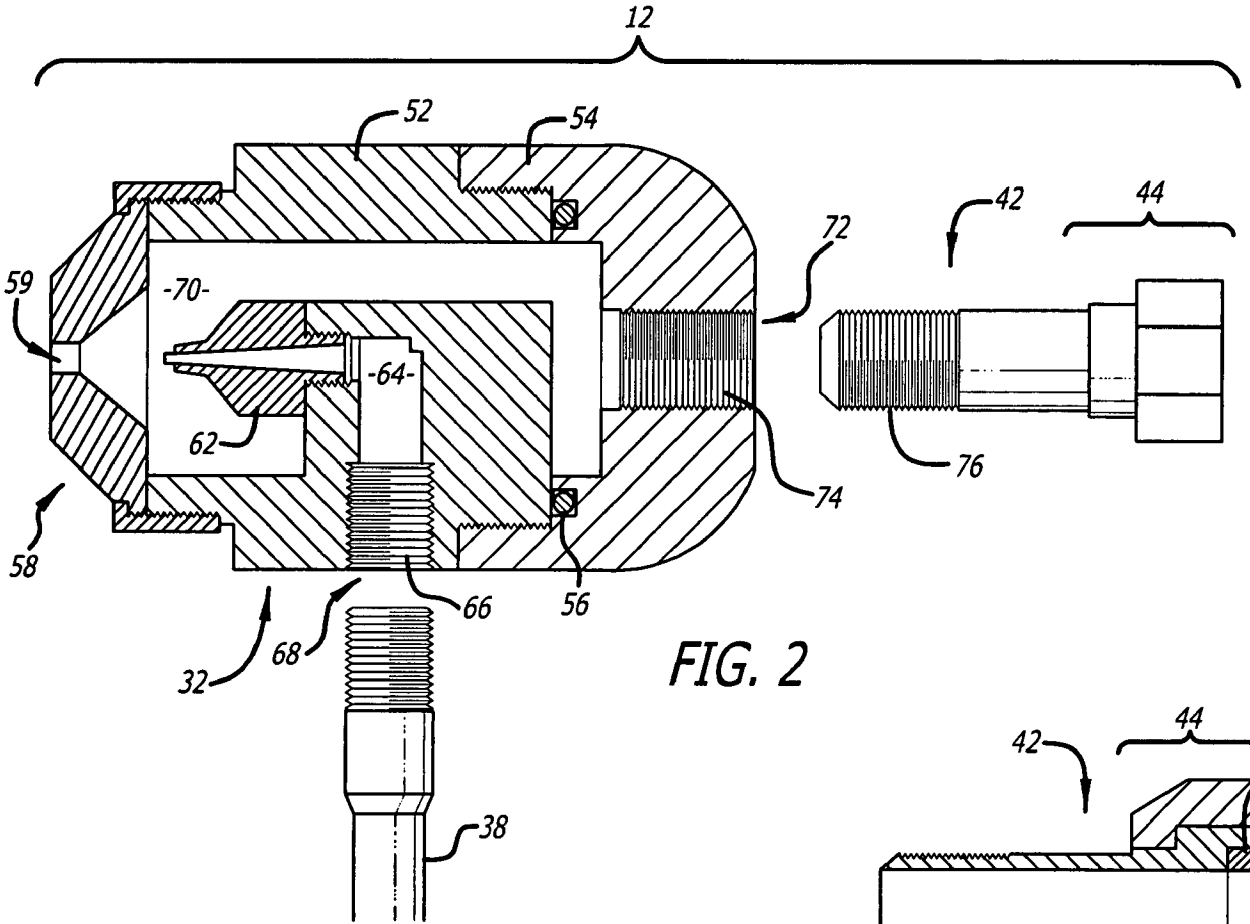
FIG. 2 is a cross-sectional view in elevation of the atomizer adapter in accordance with the invention.
Figure 3:
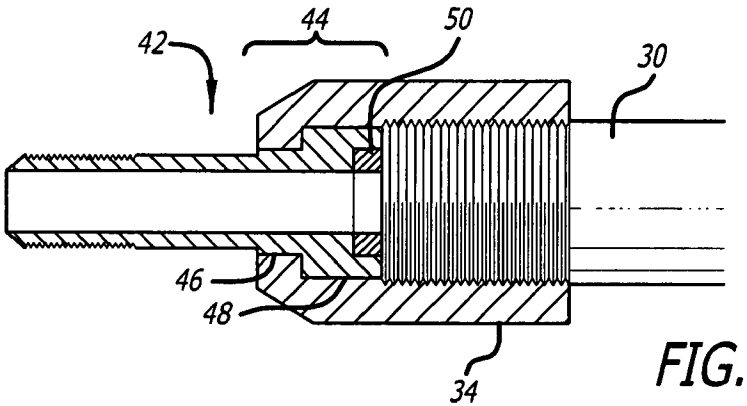
FIG. 3 is a cross-sectional view in elevation of a connector and associated apparatus for joining the adapter unit to an airless paint sprayer.

FIG. 2 is a cross-sectional view in elevation of the atomizer adapter unit 12 in accordance with the invention and FIG. 3 is a cross-sectional view in elevation of the connector 34 and associated apparatus for joining the adapter unit 12 to an airless paint sprayer. Viewing the two figures in combination, a hollow material input tube 42 for transferring drywall compound from the sprayer 10 to the atomizer adapter unit 12 includes a first end 44 having enlarged regions 46, 48 adapted to be received and captured within the front end of the connector 34. The opposed end of the connector 34 is threadedly joined to the end 30 of the output barrel 26 of the sprayer 10 while an o-ring 50 is seated within the end of the compound input tube 42 for providing a seal with the gun diffuser end of the sprayer 10.

The adapter housing 32 comprises mating front 52 and rear 54 sections. The two sections 52, 54 preferably comprise appropriately-machined pieces of aluminum that are threadedly engaged to one another for ready disassembly and cleaning. An o-ring 56 assures sealing of the interior of the housing 32. The tip 58 having an aperture 59 is threadedly engaged to the front of the housing 32 by means of the surrounding spray guard 36. A nozzle 62 is threadedly engaged to the front section 52 to receive compressed air input to the housing 32 through the conduit 38.

Pressurized air enters the housing via a bent channel 64 formed within the front section 52. The input portion of the bent channel 64 is generally vertical with internal threading 66 adjacent a port 68 for receiving the conduit 38 and is continuous with a generally-horizontal portion to which the internally-tapered nozzle 62 is fixed.

A hollow atomizing chamber 70 is defined interior to the housing 32. The chamber 70 receives compressed air provided via the conduit 38 and viscous material from the sprayer 10 via a port 72 having internal threading 74 for coupling to the threaded second end 76 of the compound input tube 42.

While the invention has been described with reference to a presently-preferred embodiment, it is not limited thereto. Rather, the invention is limited only insofar as it is defined by the following set of patent claims and includes within its scope all equivalents thereof.

What is claimed is:

1. An atomizer adapter for an airless sprayer comprising, in combination:

a) a housing;

b) said housing having a first port for receiving viscous material and a second port for receiving compressed air;

c) a hollow atomizing chamber internal to said housing for combining compressed air with said viscous material to atomize said viscous material therein; and d) a tip having an aperture for disbursing said atomized viscous material from said housing, said first port and said tip being located at opposed ends of said housing;

e) a channel in communication with said second port for receiving and preferentially directing compressed air within said hollow chamber;

f) an elongated compound input tube for receiving viscous material from the sprayer and transferring said material to said housing, i) one end of said elongated input tube being exteriorly threaded and ii) said first port being interiorly-threaded for threadedly receiving said elongated input tube;

g) a connector including an enlarged void region for coupling said atomizer adapter to the sprayer; and h) the opposed end of said elongated tube comprising an enlarged portion whereby said enlongated tube is captured and fixed to said sprayer by said connector.

* * * * *